US008687817B2

(12) United States Patent
Westergaard

(10) Patent No.: US 8,687,817 B2
(45) Date of Patent: Apr. 1, 2014

(54) METHOD AND SYSTEM FOR SURVEILLANCE OF A WIRELESS CONNECTION IN A HEARING AID FITTING SYSTEM

(75) Inventor: Anders Westergaard, Herlev (DK)

(73) Assignee: WIDEX A/S, Lynge (DK)

( * ) Notice: Subject to any disclaimer, the term of this patent is extended or adjusted under 35 U.S.C. 154(b) by 1330 days.

(21) Appl. No.: 12/134,526

(22) Filed: Jun. 6, 2008

(65) Prior Publication Data

US 2008/0240453 A1 Oct. 2, 2008

Related U.S. Application Data

(63) Continuation-in-part of application No. PCT/DK2005/000801, filed on Dec. 16, 2005.

(51) Int. Cl.
*H04R 29/00* (2006.01)

(52) U.S. Cl.
USPC ..... 381/60

(58) Field of Classification Search
CPC ..... H04R 25/70; H04R 25/30
USPC ..... 381/60, 58, 312, 381, 315, 314, 380, 381/374, 370, 322, 1, 23.1; 600/559; 73/585; 700/94; 455/39, 67.11
See application file for complete search history.

(56) References Cited

U.S. PATENT DOCUMENTS

| | | | | |
|---|---|---|---|---|
| 5,645,074 | A * | 7/1997 | Shennib et al. | 600/559 |
| 6,668,204 | B2 * | 12/2003 | Neoh | 700/94 |
| 7,016,504 | B1 * | 3/2006 | Shennib | 381/60 |
| 2003/0003868 | A1 * | 1/2003 | Juurikko | 455/41 |
| 2003/0137414 | A1 | 7/2003 | Chen | |
| 2004/0234090 | A1 | 11/2004 | Berg | |
| 2005/0283263 | A1 * | 12/2005 | Eaton et al. | 700/94 |
| 2006/0029245 | A1 | 2/2006 | Westergaard | |
| 2007/0086601 | A1 * | 4/2007 | Mitchler | 381/79 |

FOREIGN PATENT DOCUMENTS

| | | | |
|---|---|---|---|
| EP | 1022578 | A2 | 7/2000 |
| JP | 7226976 | A | 8/1995 |
| JP | 2002016539 | A | 1/2002 |
| JP | 2003515964 | T | 5/2003 |
| JP | 2003218986 | A | 7/2003 |
| JP | 2004234317 | A | 8/2004 |
| WO | 00/22874 | A2 | 4/2000 |
| WO | 0122777 | A1 | 3/2001 |
| WO | 2004/086816 | A1 | 10/2004 |

OTHER PUBLICATIONS

Japanese OA 2008-543655 dated Jan. 18, 2011.
"Baseband Specification"—Nov. 4, 2004, Bluetooth Specification, Version 2.0 + EDR (vol. 3), XP002396499 pp. 95, 242, and 393.

* cited by examiner

*Primary Examiner* — Lun-See Lao
(74) *Attorney, Agent, or Firm* — Sughrue Mion, PLLC

(57) ABSTRACT

A method is presented of evaluating a wireless connection while fitting a hearing aid. The method comprises the steps of sending a signal via the wireless connection from a computer system (103) to a portable device (102), receiving the signal in the computer system via the wireless connection from the portable device, thereby obtaining information about the wireless connection, evaluating the information in the computer system through retrieving a current value representative of the quality of the wireless communication, smoothing the current value thereby obtaining a smoothed value, and providing a quality parameter based on the smoothed value. Also a system for fitting a hearing aid, a computer program, and a computer system adapted to the use of such a method are presented.

20 Claims, 5 Drawing Sheets

METHOD AND SYSTEM FOR SURVEILLANCE OF A WIRELESS CONNECTION IN A HEARING AID FITTING SYSTEM

RELATED APPLICATIONS

The present application is a continuation-in-part of application No. PCT/DK2005/00801, filed on Dec. 16, 2005, in Denmark and published as WO-A1-2007/068243.

BACKGROUND OF THE INVENTION

1. Field of the Invention

The present invention relates to hearing aids and to the fitting of hearing aids. The invention, more specifically, relates to fitting of hearing aids using wireless communication systems. The invention, still more specifically, relates to methods for fitting hearing aids using wireless communication.

2. The Prior Art

When fitting a hearing aid to a hearing aid user a fitting system may be used. It is an industry standard to use a system comprising a portable device, e.g. a so-called NOAHlink, being connected to a computer system through a wireless connection such as Blue tooth (BT). Radio communication between two or more Blue tooth enabled devices has a short range (typically up to 10 meters depending on the type and the environmental conditions). If the user of the hearing aid moves out of the communication range, the connection is cut off. This is in particular a problem when fitting a hearing aid for a child. In some cases this means that the fitting system has to be restarted, which is very time consuming.

Though it is an advantage for the hearing aid user to be able to move more freely, as in this case, when the portable device is wireless, rather than having the portable device connected by a cable thereby tethering the portable device, it is a disadvantage that the time it takes for the fitting system to respond to a broken connection is much higher than the time it would take to respond to a problem in a wired connection. Thus it will not be possible for the fitter immediately to see that the wireless connection is broken. Since the computer system is waiting for a time-out, this may be misinterpreted as the Graphical User Interface GUI having gone frozen and the computer system consequently in need of a restart. A restart is very time consuming and may cause loss of information. In addition sometimes the wireless connection may also have recovered so that there is no need to restart the computer system but since there is no indication that the system has recovered the fitter may be tempted to turn off the computer.

A way to address the problem of monitoring the connection is to use a time out on the signal. The time out may e.g. be set in the range of 60 seconds, which may however still lead to situations where the fitter may think that the GUI has frozen and then may attempt to restart the computer, since the indication in the GUI that the portable device is out of range will only appear once the current time interval has expired.

SUMMARY OF THE INVENTION

It is an object of the invention to provide a system and a method that will enable the fitter of the hearing aid to guide the hearing aid user to stay within communication range.

It is a further object of the invention to provide a fitting system and a method that can be used in a daily day environment, such as on the street, when fitting a hearing aid.

These and other objects are fulfilled by the present invention.

The invention, in a first aspect, provides a method of evaluating a wireless connection while fitting a hearing aid, comprising the steps of establishing a wireless connection between a computer system and a portable device, connecting the portable device with the hearing aid, sending a signal via the wireless connection from the computer system to the portable device, receiving the signal in the computer system via the wireless connection from the portable device, thereby obtaining information about the wireless connection, evaluating the information in the computer system through retrieving a current value representative of the quality of the wireless communication, smoothing the current value thereby obtaining a smoothed value, providing a quality parameter based on the smoothed value, and presenting information based on said quality parameter to a user of said computer system.

With the method according to the invention it is possible to monitor the quality of a wireless connection while fitting a hearing aid, which detects the quality of the signal between a portable device, such as a NOAHlink, and a computer system without being distracted by fluctuations in the signal, due to the smoothing of a value extracted from the signal.

In an embodiment of the invention the step of evaluating may further comprise a step of transforming information from the signal into a value that reflects the transmission time.

The transmission time reflects the time it takes to transmit information from the portable device to the computer system. When the transmission time is smoothed the value reflects any difficulties in transmitting the signal, a long smoothed transmission time reflecting that the wireless connection has difficulties in transmitting the signal. In another embodiment the signal comprises statistical information about the wireless communication such as a Return Signal Strength Indicator (RSSI). It is an advantage to use statistical information since variations in the signal may already have been taken into account though today even statistical information like the RSSI fluctuates and therefore needs to be further smoothed before evaluating the quality of the wireless connection. An even more reliable result may be achieved by taking into account at least two different values for indicating the quality of the wireless connection, such as the bit rate and the RSSI at the same time.

In another embodiment of the invention a method is implemented, wherein said step of smoothing the value is based on processing a set of prior values and the current value. It is an advantage to use only one value based on one signal since it is then not necessary to store any prior information or values in the computer system. But also a set of prior values and the current value may be used in smoothing the current value, e.g. by a moving average. In an embodiment of the invention the receiving step further comprises storing the current value in a memory.

In yet another embodiment of the invention said step of providing a quality parameter further comprises presenting information based on said quality parameter to a user. It is an advantage to provide information about the quality of the wireless information to a user, e.g. a fitter of the hearing aid, since it is then possible for the user to guide the hearing aid user in whether the hearing aid user is about to get out of the range covered by the wireless connection. A way to do this could be by presenting the information as a color on a Graphical User Interface, wherein the color reflects the value of the quality parameter.

The quality may e.g. be classified among three levels. By indicating the quality of the wireless connection in a color it is easily seen when the quality changes. This may e.g. be done by changing the color gradually so that it e.g. changes from a green color when the quality of the wireless connection is good to a red color when the quality is critical. Preferably there will only be a number of levels of colors each presenting a grade in the quality of the wireless connection, e.g. three levels where a green color represents a good grade, a yellow represents a warning grade, indicating to the user to get into reach, and a red color represents a critical grade indicating that the connection is about to drop out or already has dropped out.

It is preferable to have a clear indication of the quality of the wireless connection, such as a low number of grades, since it makes it easier for the user to interpret the quality and avoids distracting the user of the fitting system, who has a lot of other information to check. It may therefore also be an advantage to give an alert if the quality parameter of the wireless communication is at a predetermined level, e.g. drops below a predetermined quality value and thus enters into a critical quality range. The alert may e.g. be given as a sound alert e.g. directly to the hearing aid user or emitted from the computer system, alternatively the alert could be a message, e.g. providing information that the hearing aid user is moving is approaching a critical zone etc.

In another embodiment of the invention said step of smoothing said value further comprises checking if the current value is subject to a steady change and if so then reflecting the permanent change in the smoothed value. It is an advantage to implement a permanent change check since in this way it will be possible to react earlier if e.g. the quality of the wireless connection suddenly becomes critical.

The invention, in a second aspect, provides a computer system for fitting a hearing aid, said computer system comprising a wireless communication driver adapted to exchange a signal with a wireless communication radio connected with the hearing aid thereby providing information about the wireless communication between said wireless communication driver and said wireless communication radio, a smoothing component adapted to extract a current value based on said information and to smooth said current value in order to derive a smoothened value, a link quality component adapted to evaluate said smoothened value thereby determining whether to trip a warning, and a graphical user interface for presenting said information about the quality of the wireless connection to a user of said computer system.

In an embodiment a computer system is provided, wherein said smoothing component is adapted to extract a value reflecting a transmission time of said signal. Another way may be to use a signal that provides information about the Return Signal Strength Indicator (RSSI).

In another embodiment a computer system is provided, wherein said smoothing component comprises a smoothing algorithm.

The invention, in a third aspect, provides a computer program product, containing executable program code which, when executed on a computer, executes a method of evaluating a wireless connection while fitting a hearing aid, the method comprising the steps of establishing a wireless connection between a computer system and a portable device, connecting the portable device with the hearing aid, sending a signal via the wireless connection from the computer system to the portable device, receiving the signal in the computer system via the wireless connection from the portable device, thereby obtaining information about the wireless connection, evaluating the information in the computer system through retrieving a current value representative of the quality of the wireless communication, smoothing the current value thereby obtaining a smoothed value, providing a quality parameter based on the smoothed value, and presenting information based on said quality parameter to a user of said computer system.

The invention, in a fourth aspect, provides a system for fitting a hearing aid, comprising a portable device connected with said hearing aid, said portable device comprising a first wireless communication means, a computer system, said computer system having a fitting software component, a second wireless communication means adapted to communicate with said first wireless communication means thereby obtaining a signal reflecting the quality of the wireless connection, a quality component adapted to extract a current value based on the signal and smooth said current value thereby obtaining information about the quality of the wireless connection, and a graphical user interface for presenting said information about the quality of the wireless connection to a user of said computer system.

In an embodiment a system is presented, wherein said computer system is adapted to store a set of prior values extracted on a number of prior signals and wherein the quality component is adapted to smooth said current values by processing said set of prior values and said current value.

In still another embodiment a system is provided, wherein said computer system further comprises audio means adapted to present an audible alert based on said information about the quality of wireless connection. The audio means may e.g. be an output transducer in a personal computer or a loudspeaker connected to the computer system.

In another embodiment a system is provided, wherein said audio means are positioned in a computer system. This may be an advantage since it will be possible for a user, such as the fitter, to hear if the hearing aid user is moving out of reach. In an alternative embodiment said audio means are positioned in said hearing aid, in this way the hearing aid user may be warned directly and can thus move according to the alert.

In an embodiment of the invention a system is provided, wherein the computer system further comprises a steady change component.

Still other features of the present invention will become apparent to those skilled in the art from the following description wherein the invention will be explained in greater detail.

BRIEF DESCRIPTION OF THE DRAWINGS

The invention will now be described in more detail in conjunction with several embodiments and the accompanying drawings, in which.

DETAILED DESCRIPTION OF THE INVENTION

Figure 1:
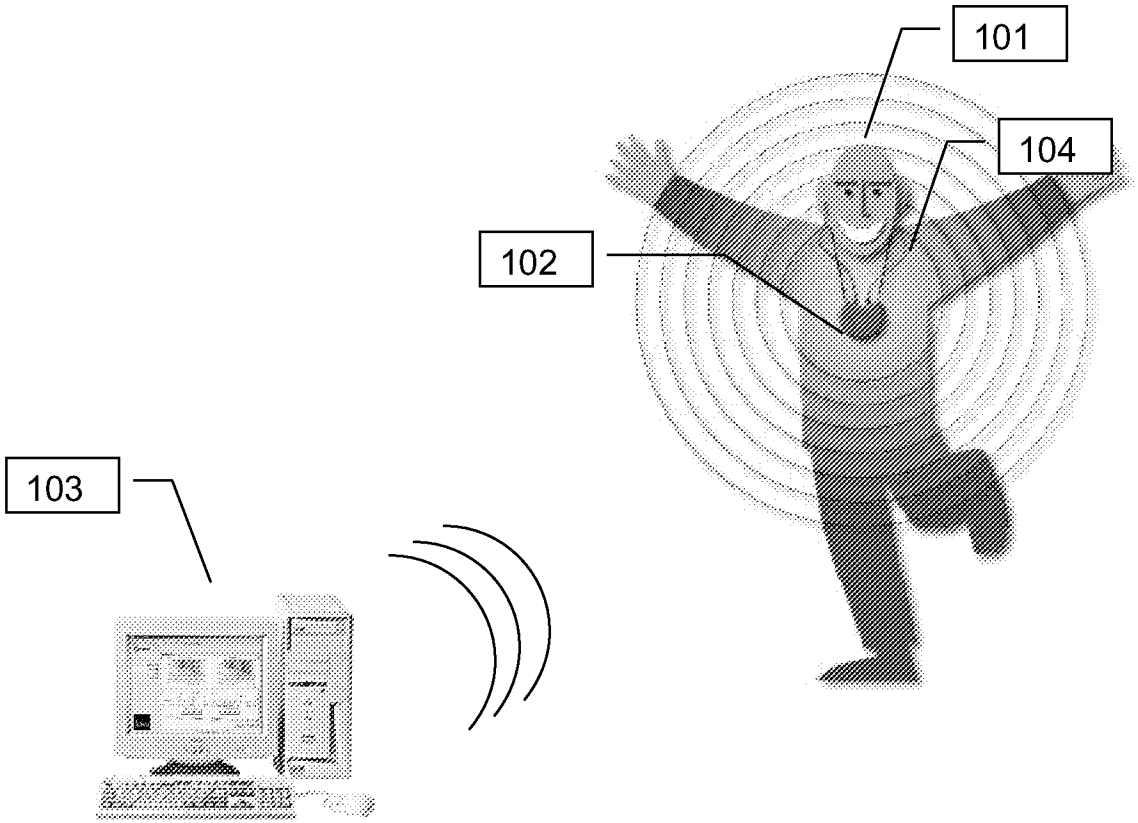
FIG. 1 shows a fitting system for a hearing aid.

FIG. 1 shows a fitting system for fitting one or two hearing aids for a hearing aid user 101. The hearing aid user 101 may have one or two hearing aids that are connected, e.g. via cables 104, to a portable device 102 such as a NOAHlink. The computer system 103 comprises fitting software that may program the hearing aids via a high-speed wireless connection to the portable device 102. The wireless connection may be e.g. a Blue tooth connection. The computer system 103 may be a personal computer, a client in a client server environment, a hand held computer device such as a pocket computer, or a smart phone, or a combination thereof. Preferably the computer system comprises a Graphical User Interface (GUI) 3. In a preferred embodiment of the invention the quality of the communication will be classified among a number of levels such as three levels: a satisfactory level, a warning level and a critical level and thereafter presented in the GUI. The quality level of the communication will be presented in the GUI, so that the fitter will be able to instruct the hearing aid user to move into a better communication area. E.g. a satisfactory level may be presented to the fitter as a green color, a warning level as yellow and a critical level as red. If the quality is at a satisfactory level the fitter may continue without paying attention to where the hearing aid user is situated. If the quality changes into a warning level the fitter may be alerted e.g. by a change in color, a sound or a message that the wireless connection may be lost if the hearing aid user moves further away from the computer system. Likewise if the quality changes into an uncritical level again the fitter may be informed that the wireless connection is within reach again.

It may also be an advantage to show a quality indicator in the GUI continuously so that it will be possible for the fitter to react to changes in the quality indicator by watching the quality indicator. The fitter may simultaneously be guided by e.g. showing the color codes as explained above.

Typically a computer application that uses a Blue tooth application will interface directly with the BT stack. Through this interface the computer application will be able to scan for other BT devices, establish connection to a BT device, get events if a new BT radio gets within reach, and finally obtain statistical information of e.g. Return Signal Strength Indicator (RSSI). The RSSI provides information about the quality of the wireless BT connection. Some of the BT devices provide an application showing the quality of the RSSI in a GUI. This can e.g. be done by a bar that illustrates the RSSI, so that the length of a colored bar varies with the changes in RSSI. The bar varies between being too weak, good and too strong. If the signal strength gets too weak the wireless connection may be cut off. The bar may vary between too weak and good even when the distance between the BT device and the BT radio is approximately constant, as the signal not only depends on the distance between the two but also depends on other factors such as the mutual position of the BT device and the BT radio. Even if the wireless connection is cut off it may be possible to re-establish it once the BT device and the BT radio have been moved into a good transmission distance.

When evaluating the quality of the wireless BT connection it may therefore be an advantage to evaluate the amount of data that are transmitted, e.g. the bit rate. It is possible that even while the signal strength bar indicates that the RSSL is too weak the bit rate may be satisfactory. It is also possible that even after the signal strength bar has decreased to too weak and the bit rate has become dissatisfactory the bit rate may slowly increase to a satisfactory level. Even in cases where the wireless communication has been cut off and then re-established the bit rate may slowly increase to a satisfactory level.

Since the signal strength may fluctuate between too weak and good even while the hearing aid user is in the same position but the BT radio is moved around (while the bit rate is at a satisfactory level) the signal strength bar provided with the BT application is not suitable for the fitter to monitor. Furthermore not all BT devices have information about the RSSI.

A way to overcome this and other problems may be by use of an embodiment according to the invention as the one shown in FIGS. 2-5.

Figure 2:
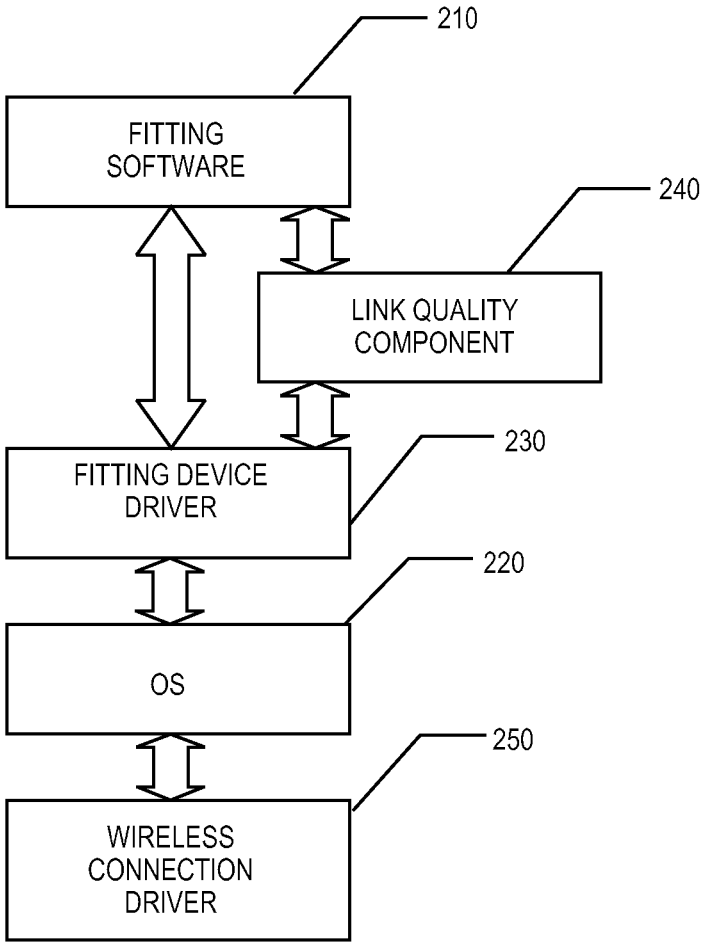
FIG. 2 shows a computer system comprising fitting software.

FIG. 2 shows a computer system that may be used when fitting a hearing aid according to an embodiment of the invention. The computer system comprises a number of elements such as a fitting software component 210, the Operative System OS 220, a portable device driver 230, a link quality component 240 and a wireless connection driver 250. The elements can be adapted to communicate mutually in order to exchange information. In an embodiment of the invention the fitting component 210 is adapted to communicate with the link quality component 240 and the OS 220, which may comprise the wireless connection driver 250. It will be obvious for a person skilled in the art how to establish the connections, depending on the choice of portable device 230, wireless connection 250 and fitting software 210. It is also possible that the fitting software comprises the link quality component 240.

Figure 3:
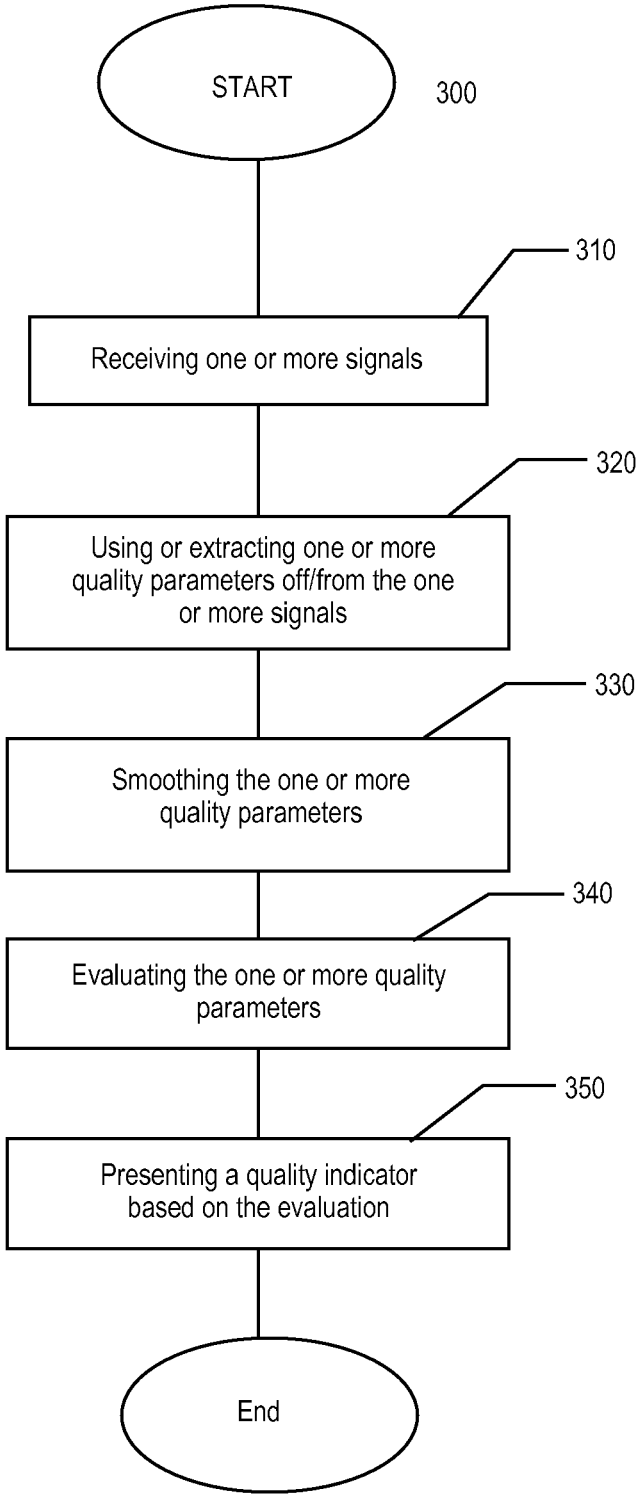
FIG. 3 shows a flow diagram of the quality evaluation of one or more signals from a wireless communication.

FIG. 3 is a flow diagram 300 of a method of the quality evaluation of one or more signals originating from the wireless connection. The method may be implemented in the link quality component 240. The signals are, according to an embodiment of the invention, evaluated by a computer system e.g. as the one shown in FIG. 2.

As a step 310, one or more signals from the wireless connection are received by the link quality component. The signals may be used directly or one or more parameters may be extracted from the signals thereby obtaining one or more quality parameters as illustrated in step 320. In a step 330 the one or more quality parameters are smoothed in order to reduce fluctuations in the quality parameters. The smoothing provides a modification of a set of signals to make it smooth and nearly continuous and remove or diminish outlying points. In step 340 the one or more quality parameters are evaluated, and finally in step 350 a quality indication is presented, e.g. in a GUI.

Figure 4:
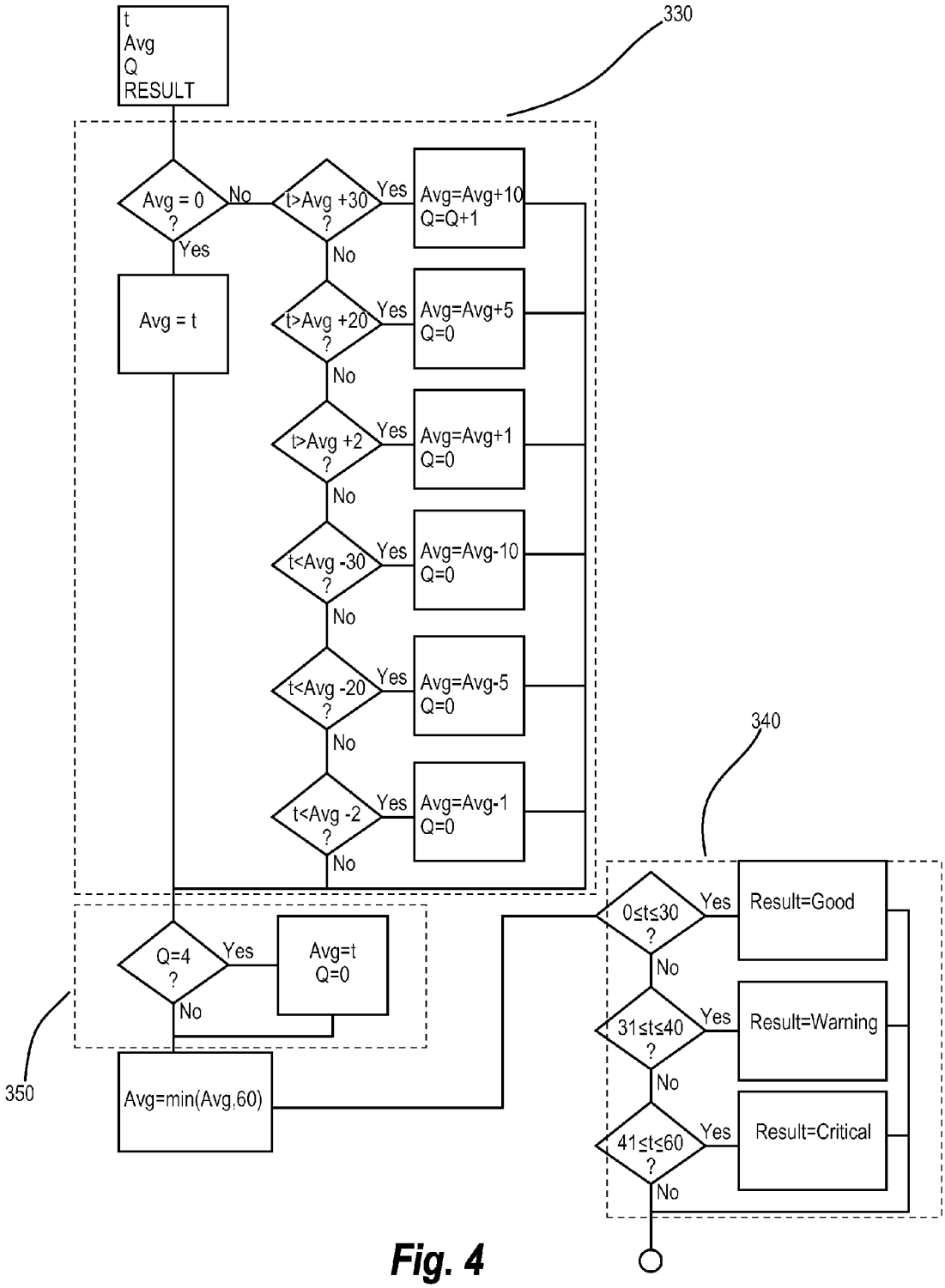
FIG. 4 shows a block diagram comprising a smoothing algorithm and a warning algorithm.

FIG. 4 shows a block diagram comprising a smoothing algorithm 330 and a classification algorithm 340. The smoothing algorithm 330 is initiated with t, which is the transformation of the signal into the transmission time, i.e. the time it has taken for the signal to be emitted from the computer system and received by the portable device and then returned back to the computer system. Avg=0, q=0 and Result="". Thus the first time a signal is received at t:=t1 and thus Avg=t1. The second time a signal is received occurs at t=t2, and thus Avg=t1 will be compared with t2. The smoothing algorithm 330 corresponds to the one shown in the following:

$Avg+Critical<t \Rightarrow Avg=Avg+a, Q=Q+1$ $Avg+Warning<t\leq Avg+Critical \Rightarrow Avg=Avg+b, Q=0$ $Avg+Good<t\leq Avg+Warning \Rightarrow Avg=Avg+c, Q=0$ $Avg-Good\leq t\leq Avg+Good \Rightarrow$ no changes in Avg, $Q=0$ $Avg-Warning\leq t<Avg-Warning \Rightarrow Avg=Avg-c, Q=0$ $Avg-Critical\leq t<Avg-Warning \Rightarrow Avg=Avg-b, Q=0$ $t<Avg-Critical \Rightarrow Avg=Avg-a, Q=0$ In a preferred embodiment the grade levels are the following: Critical=30, Warning=20, Good=2, A=10, B=5, C=1. Naturally the levels can be varied and should be determined depending on the kind of signal and the wanted sensitivity of the smoothing. Also the number of intervals that t is classified into can be decreased or increased, thus reflecting the number of grade levels.

By smoothing the signal in this way fluctuations in a group of signals will be removed or diminished. It is an advantage of the method that it can be effectuated based on only one signal (if e.g. Avg is set to e.g. 20 in the beginning).

Due to the smoothing algorithm a continuous increase in the signal will be dampened delaying the response. In order to overcome that the damping will excessively delay the time too much in order to react to a permanent change in the signal, a permanent change algorithm may be introduced. The embodiment shown in FIG. 4 includes a permanent change algorithm 350 that once the signal has entered into a critical area four times in a row sees to that the signal is increased over the maximum value (in this case Avg=Avg+Critical) and sets Avg=t, in this case a max value=60 corresponding to the time out value. By doing this, a permanent increase in the signal will be detected and the Avg will be increased to the new level. Obviously a similar way of detecting permanent decrease in the value can be detected and Avg can be corrected according to the new level.

In the categorization algorithm 340 it is determined whether the value of Avg results in a good, warning or a critical quality of the wireless communication. In a preferred embodiment a Result=Good will be presented on a GUI as a green color, a Result=Warning as a yellow color and a Result=Critical as a red color. The number of colors may vary depending on the wanted quality levels in the categorization algorithm. It is an advantage to keep the number of levels low such as 3-5 since it should be kept simple for the fitter to interpret the information about the wireless communication. The change in level may be notified by an acoustic alert, e.g. a sound signifying Result=Warning or Result=Critical. The sound may e.g. be a tone, a melody or a spoken message. Also variations in the sound output may be associated with the quality of the wireless communication, e.g. such that a tone increases in frequency as the Avg increases when the quality is at the warning level or the critical level.

Figure 5:
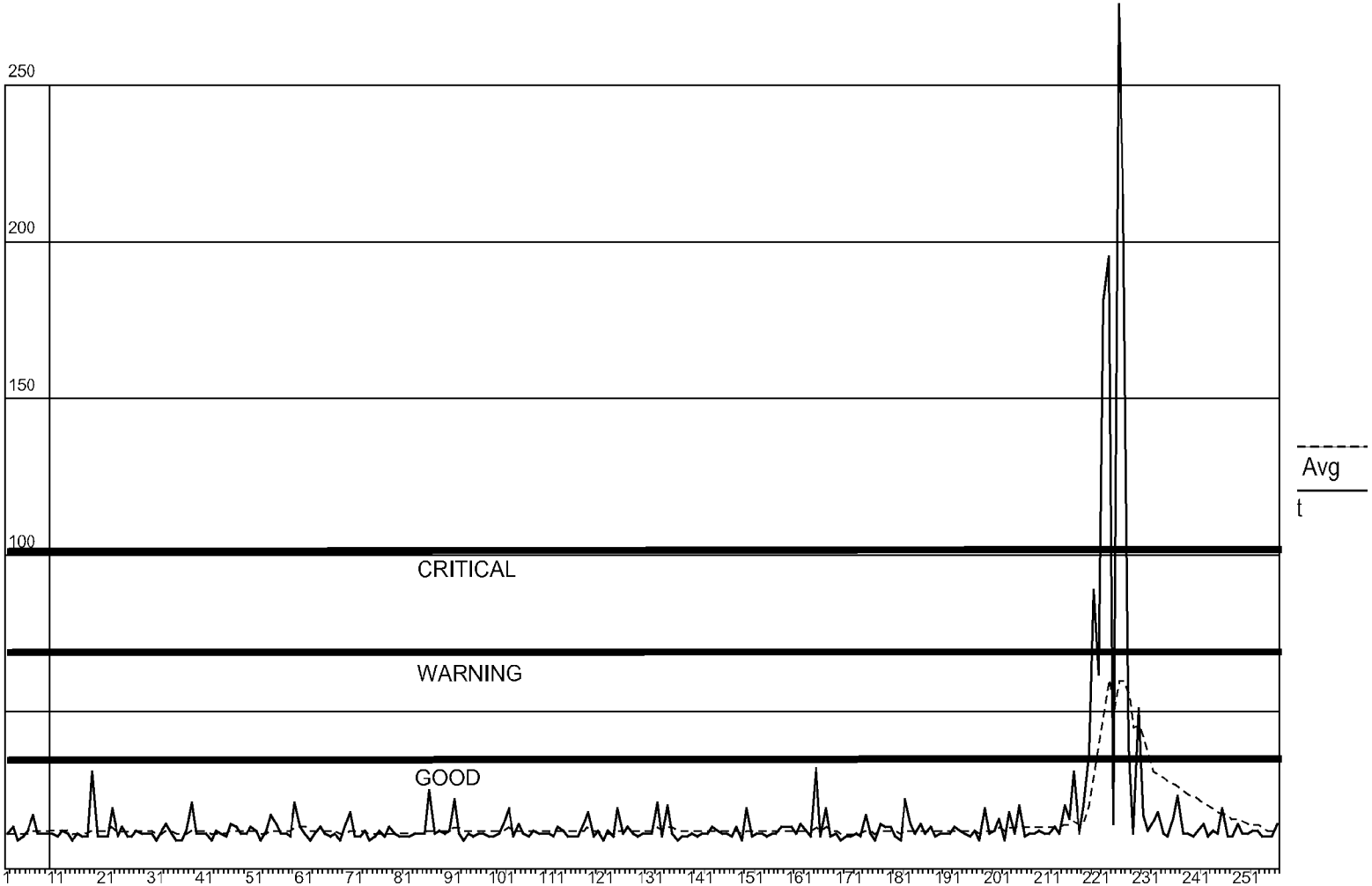
FIG. 5 shows graph of a series of time estimates and their corresponding smoothed estimates.

FIG. 5 shows a series of transmission times t calculated on bases of a series of signals that have been collected over a period of time. For each transmission time a smoothed time estimate is determined by use of the algorithm 330 and algorithm 340 (shown in FIG. 4, explained above). As it appears in the series of smoothed time estimates the outlying points in the current time estimate series have almost been removed. Furthermore the algorithm provides for a time lag when large variations in the current time estimate appear. By evaluating the smoothed time estimate by the categorization algorithm 340 a quality of the signal can be provided. In the figure the three quality grade intervals used in the categorization algorithm 340 are indicated by the areas Good, Warning and Critical.

Other ways of smoothing the transmission time can be carried out by using a smoothing algorithm based on a series of adjacent transmission times. E.g. a rectangular or unweighted sliding-average smooth or a triangular smooth may be used, that replaces each point in the signal with the average of m adjacent signals, where m is a positive integer called the smooth width, e.g. m=3.

I claim:

1. A method of evaluating a wireless connection while fitting a hearing aid, comprising the steps of establishing a wireless connection between a computer system and a portable device, connecting the portable device with the hearing aid, sending a signal via the wireless connection from the computer system to the portable device, receiving the signal in the computer system via the wireless connection from the portable device, thereby obtaining information about the wireless connection, evaluating the information in the computer system through retrieving a current value representative of the quality of the wireless communication, smoothing the current value thereby obtaining a smoothed value, providing a quality parameter based on the smoothed value, and presenting information based on said quality parameter to a user of said computer system.

2. The method according to claim 1, wherein the step of evaluating comprises a step of transforming information from the signal into a value that reflects the transmission time.

3. The method according to claim 1, wherein the signal comprises statistical information about the wireless communication.

4. The method according to claim 1, wherein the signal is a Return Signal Strength Indicator (RSSI).

5. The method according to claim 1, wherein said step of smoothing the value is based on processing a set of prior values and the current value.

6. The method according to any of the preceding claims, wherein said receiving step further comprises storing the current value in a memory.

7. The method according to claim 1, wherein the information is presented as a color on a Graphical User Interface, the color reflecting the value of the quality parameter.

8. The method according to claim 1, wherein an alert is given if the quality parameter of the wireless communication drops below a predetermined level.

9. The method according to claim 1, wherein said step of smoothing the current value comprises checking if the current value is subject to a steady change and if so then reflecting the permanent change in the smoothed value.

10. A computer system for fitting a hearing aid, said computer system comprising a wireless communication driver adapted to exchange a signal with a wireless communication radio connected with the hearing aid thereby providing information about the wireless communication between said wireless communication driver and said wireless communication radio, a smoothing component adapted to extract a current value based on said information and to smooth said current value in order to derive a smoothened value, a link quality parameter component adapted to evaluate said smoothened value and provide a quality parameter, and determining whether to trip a warning, and a graphical user interface for presenting said information about the quality parameter of the wireless connection to a user of said computer system.

11. The computer system according to claim 10, wherein said smoothing component is adapted to extract a value reflecting a transmission time of said signal.

12. The computer system according to claim 10, wherein the signal provides information about the Return Signal Strength Indicator (ångstrøm).

13. The computer system according to claim 10, wherein said smoothing component comprises a smoothing algorithm.

14. A computer program product, containing executable program code which, when executed on a computer, executes a method of evaluating a wireless connection while fitting a hearing aid, the method comprising the steps of establishing a wireless connection between a computer system and a portable device, connecting the portable device with the hearing aid, sending a signal via the wireless connection from the computer system to the portable device, receiving the signal in the computer system via the wireless connection from the portable device, thereby obtaining information about the wireless connection, evaluating the information in the computer system through retrieving a current value representative of the quality of the wireless communication, smoothing the current value thereby obtaining a smoothed value, providing a quality parameter based on the smoothed value, and presenting information based on said quality parameter to a user of said computer system.

15. A system for fitting a hearing aid, comprising a portable device connected with said hearing aid, said portable device comprising a first wireless communication means, a computer system, said computer system having a fitting software component, a second wireless communication means adapted to communicate with said first wireless communication means thereby obtaining a signal reflecting the quality of the wireless connection, a quality component adapted to extract a current value based on the signal and smooth said current value thereby obtaining information about the quality of the wireless connection, and a graphical user interface for presenting said information about the quality of the wireless connection to a user of said computer system.

16. The system according to claim 15, wherein said computer system is adapted to store a set of prior values extracted on a number of prior signals and wherein the quality component is adapted to smooth said current values by processing said set of prior values and said current value.

17. The system according to claim 15, wherein said computer system comprises audio means adapted to present an audible alert based on said information about the quality of wireless connection.

18. The system according to claim 17, wherein said audio means are positioned in a computer system.

19. The system according to claim 17, wherein said audio means are positioned in said hearing aid.

20. The system according to claim 15, wherein computer system comprises a steady change component.

* * * * *